US012171341B2

(12) United States Patent
Meccola

(10) Patent No.: US 12,171,341 B2
(45) Date of Patent: Dec. 24, 2024

(54) STACKABLE FURNITURE SET

(71) Applicant: Franco Meccola, Vaudreuil Dorion (CA)

(72) Inventor: Franco Meccola, Vaudreuil Dorion (CA)

(73) Assignee: SCIRST INC., White, GA (US)

( * ) Notice: Subject to any disclaimer, the term of this patent is extended or adjusted under 35 U.S.C. 154(b) by 0 days.

(21) Appl. No.: 17/496,522

(22) Filed: Oct. 7, 2021

(65) Prior Publication Data

US 2023/0115777 A1 Apr. 13, 2023

(51) Int. Cl.

| | |
|---|---|
| ***A47C 3/04*** | (2006.01) |
| ***A47B 3/00*** | (2006.01) |
| ***A47C 17/86*** | (2006.01) |

(52) U.S. Cl.

CPC ..... *A47C 3/04* (2013.01); *A47B 3/00* (2013.01); *A47C 17/86* (2013.01)

(58) Field of Classification Search

CPC ..... A47C 3/04; A47C 17/86

See application file for complete search history.

(56) References Cited

U.S. PATENT DOCUMENTS

| | | | | |
|---|---|---|---|---|
| 3,817,573 | A * | 6/1974 | Facury | A47C 3/04 108/62 |
| 5,938,287 | A * | 8/1999 | Donnelly | A47C 7/54 297/411.42 |
| 6,179,382 | B1 * | 1/2001 | Schwartz | A47C 5/02 297/239 |
| 7,758,128 | B2 * | 7/2010 | Schwartz | A47B 83/00 297/440.1 |
| 9,565,946 | B1 * | 2/2017 | Watton | A47C 11/00 |

* cited by examiner

*Primary Examiner* — David R Dunn
*Assistant Examiner* — Tania Abraham
(74) *Attorney, Agent, or Firm* — Kimball Anderson; Jeffery M. Lillywhite

(57) ABSTRACT

A stackable furniture set. The stackable furniture set includes a first seat. The first seat includes four legs, a first armrest and a second armrest. The first seat also includes a seat area support. The first armrest is attached to a first end of the seat area support the second armrest is attached to the second end of the seat area support, where the second end of the seat area support is opposite the first end. The first seat further includes a first gap between the first armrest and the seat area support and a second gap between the second armrest and the seat area support. The first seat additionally includes one or more apertures in the seat area support. The stackable furniture set also includes a second seat. The second seat includes four legs and a seat area support where one leg passes through the first gap and one leg passes through one aperture.

20 Claims, 7 Drawing Sheets

STACKABLE FURNITURE SET

CROSS-REFERENCE TO RELATED APPLICATIONS

Not applicable.

BACKGROUND OF THE INVENTION

Shipping and storage costs have increased dramatically in the recent past. This is especially true in the furniture industry. This increase in cost is in part due to factors such as the increased demand for furniture (more furniture needs to be kept in stock) and the increasing size of furniture (the furniture then takes up more storage and shelf space).

In addition, it is more difficult than ever to find shipping. Shipping companies are busier than ever. This has led to delays and cost increases and in comes cases outright refusal to take on shipping contracts. This is especially true in the trucking industry where demand for drivers exceeds the supply of drivers. This shortage has placed a premium on storage space.

Finally, with the rise of e-commerce retail outlets face greater pressure to find ways to reduce costs. This means that they have a large incentive to reduce storage space and maximize retails space. This allows these outlets to increase the offerings to consumers without increasing total space.

One area in which these different pressures all converge is in furniture sets. In general, each piece of furniture in the set is packaged, stored, and shipped separately. This is in part due to the fact that each piece is fungible. I.e., the customer doesn't care which couch he/she receives, only that a couch is included as part of a furniture set. Thus, a store can have multiples of each box in a furniture set and the customer receives one of each of the boxes. However, this system adds to packaging space and cost, because it leads to a high amount of unused space.

In addition, furniture sets packaged in multiple boxes add to the cost and complexity of shipping. In particular, the shipping company, in general, needs to make sure that all boxes arrive simultaneously. This is both for customer convenience and for logistical reasons. That is, a customer expects all boxes to arrive simultaneously and it is better for the shipping company to only have to stop a single time, even if multiple boxes are being shipped. This means that the shipping company needs to not only track a single package, but a group of boxes as a complete set.

Accordingly, there is a need in the art for a furniture set that can reduce the amount of space needed for storage and shipping.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a stackable furniture set. The stackable furniture set includes a first seat. The first seat includes four legs, a first armrest and a second armrest. The first seat also includes a seat area support. The seat area support is configured to support the weight of a user and is supported by the one or more legs. The first armrest is attached to a first end of the seat area support the second armrest is attached to the second end of the seat area support, where the second end of the seat area support is opposite the first end. The first seat further includes a first gap between the first armrest and the seat area support and a second gap between the second armrest and the seat area support. The first seat additionally includes one or more apertures in the seat area support. The stackable furniture set also includes a second seat. The second seat includes four legs and a seat area support. The seat area support is configured to support the weight of a user and the seat area support is supported by the one or more legs. The distance between a first rear leg of the second seat and a second rear leg of the second seat is equal to the distance between the first gap and one of the one or more apertures such that the first rear leg of the second seat can be placed in the first gap and the second rear leg of the second seat can be placed on one of the one or more apertures.

Another example embodiment includes a stackable furniture set, the stackable furniture set includes a couch. The couch includes four legs, a first armrest and a second armrest. The couch also includes a seat area support. The seat area support is configured to support the weight of a user and is supported by the one or more legs. The first armrest is on a first end of the seat area support the second armrest is on the second end of the seat area support, where the second end is opposite the first end. The couch further includes a first gap between the first armrest and the seat area support and a second gap between the second armrest and the seat area support. The couch additionally includes one or more apertures in the seat area support and a backrest, where the backrest is attached to the seat area support. The stackable furniture set also includes a pair of club chairs. Each of the club chair includes four legs and a seat area support. The seat area support is configured to support the weight of a user and the seat area support is supported by the one or more legs. Each of the club chairs also includes a backrest, where the backrest is attached to the seat area support. The distance between a first rear leg of the club chair and a second rear leg of the club chair for each of the pair of club chairs is equal to the distance between the first gap and one of the one or more apertures such that for each club chair the first rear leg of the club chair can be placed in the first gap and the second rear leg of the club chair can be placed on one of the one or more apertures.

Another example embodiment includes a stacked furniture set. The stacked furniture set includes a couch. The couch includes four legs, a first armrest and a second armrest. The couch also includes a seat area support. The seat area support is configured to support the weight of a user and is supported by the one or more legs. The first armrest is attached to a first end of the seat area support and the second armrest is attached to the second end of the seat area support, where the first end is opposite the second end. The couch also includes a first gap between the first armrest and the seat area support and a second gap between the second armrest and the seat area support. The couch further includes a first aperture in the seat area support where the first aperture is closer to the first gap than the second gap and a second aperture in the seat area support where the second aperture is closer to the second gap than the first gap. The couch additionally includes a backrest, where the backrest is attached to the seat area support. The stacked furniture set also includes a first club chair. The first club chair includes four legs. The four legs include a first rear leg, a second rear leg, a first front leg and a second front leg. The first club chair also includes a seat area support. The seat area support is configured to support the weight of a user and is supported by the one or more legs. The first club chair further includes a backrest, where the backrest is attached to the seat area support. The stacked furniture set also includes a second club chair. The second club chair includes four legs. The four legs include a first rear leg, a second rear leg, a first front leg and a second front leg. The second club chair also includes a seat area support. The seat area support is configured to support the weight of a user and is supported by the one or more legs. The second club chair further includes a backrest, where the backrest is attached to the seat area support. The first rear leg of the first club chair passes through the first gap in the couch and the second rear leg of the first club chair passes through the first aperture in the couch. The first rear leg of the second club chair passes through the second gap in the couch and the second rear leg of the second club chair passes through the second aperture in the couch.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
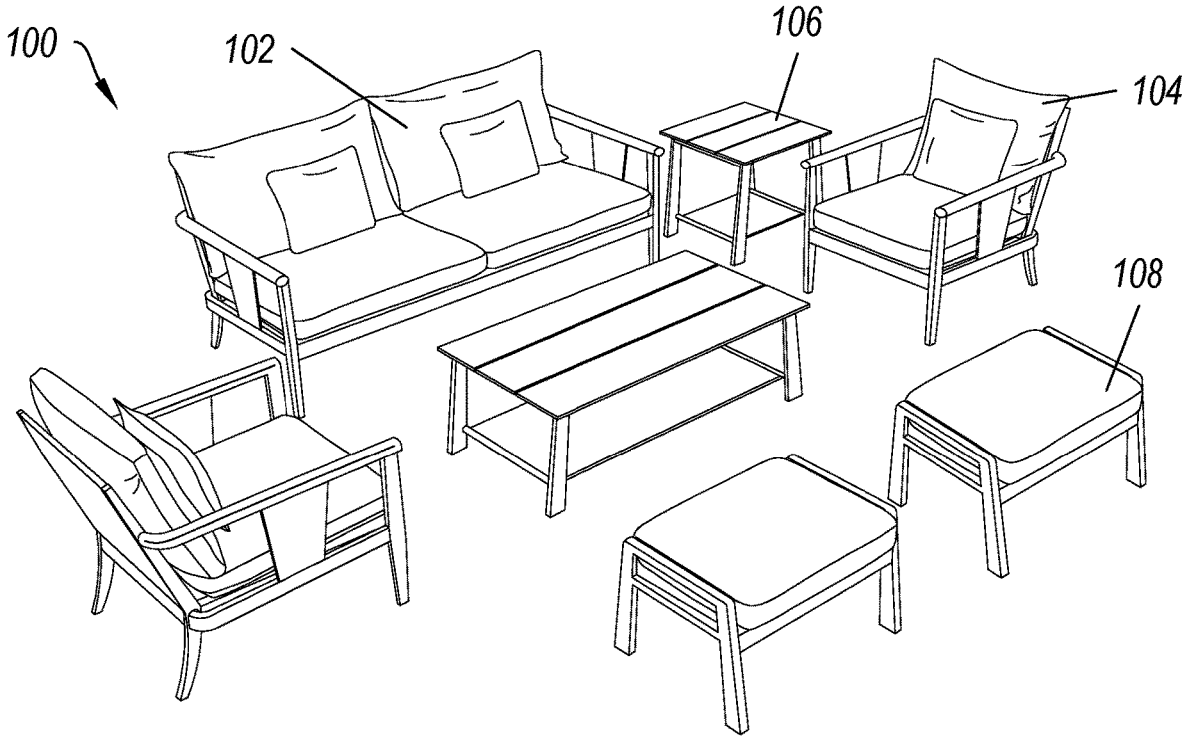
FIG. 1 illustrates an example of a stackable furniture set.

FIG. 1 illustrates an example of a stackable furniture set 100. The stackable furniture set 100 has multiple different pieces of furniture which are stackable with one another. I.e., the stackable furniture set 100 is not a chair stacked on another chair, instead it is different furniture pieces that can stack on one another.

FIG. 1 shows that the stackable furniture set 100 can include a first seat 102. The first seat 102 is simply a place where a user can sit. I.e., it is a piece of furniture on which a user has his/her weight supported in a sitting position. One of skill in the art will understand that the first seat 102 can be used in another manner (such as laying down) but sitting will be one possible use. For example, the first seat 102 can include a couch. The couch can include either a loveseat or a sofa. As used herein "loveseat" refers to a couch which is designed to seat two people and "sofa" refers to a couch which is designed to seat three or more people.

FIG. 1 also shows that the stackable furniture set 100 can include a second seat 104. The second seat 104 is smaller than the first seat 102. This is crucial because the second seat 104 is stacked on the first seat 102, as described below. For example, the second seat 104 can include a smaller sofa, a loveseat, a club chair or similar articles of furniture. A club chair is similar to a couch in design and shape except that the club chair is designed to seat only a single person.

FIG. 1 further shows that the stackable furniture set 100 can include one or more tables 106. A table is an item of furniture with a flat top and one or more legs, used as a surface for working at, eating from or on which to place things. The one or more tables 106 can include a dining room table, coffee table or an end table, or any other type of table. The tables 106 are likewise stackable with the first seat 102 and the second seat 104 as described below.

FIG. 1 further shows that the stackable furniture set 100 can include one or more footstools 108. A footstool 108 (foot stool, footrest, foot rest) is a piece of furniture or a support used to elevate the foot. The footstools 108 are typically a short four-legged stool with an upholstered and/or padded top. The top acts as a support for the user's feet. The one or more footstools 108 are stackable with the table 106, the first seat 102 and/or the second seat 104. One of skill in the art will appreciate that the stackable furniture set 100 need not include each of these pieces of furniture; however, these pieces may be found included and are stackable in a way that conserves space and maximizes space usage during shipping and storage.

Figure 2:
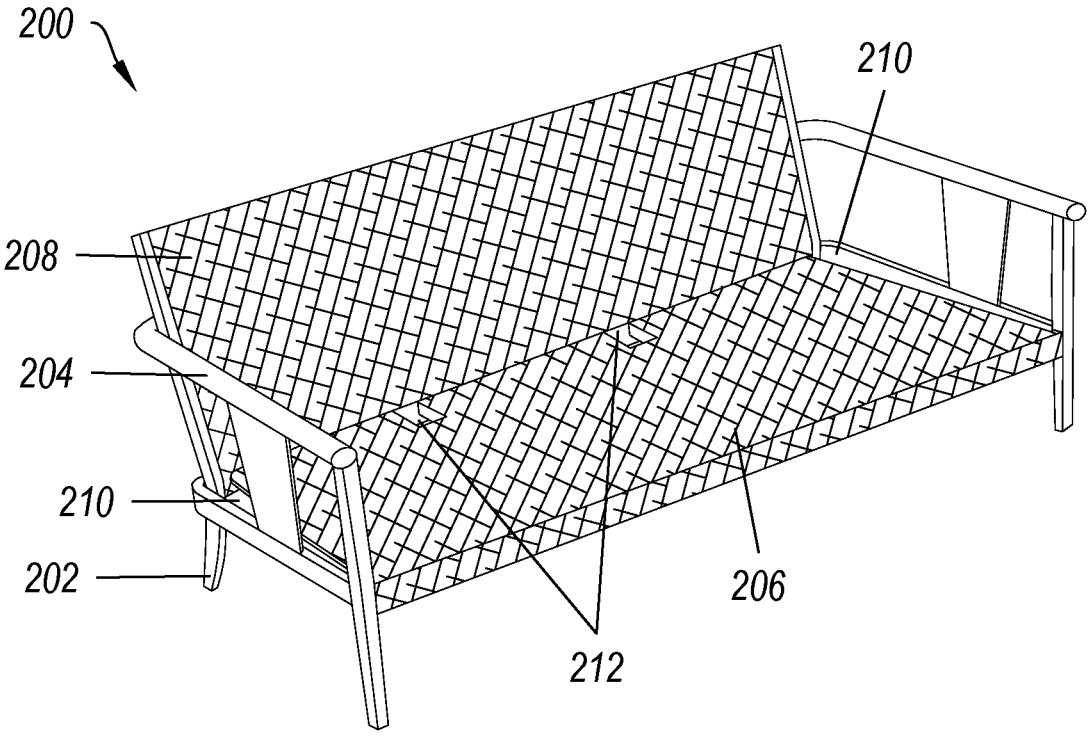
FIG. 2 illustrates an example of a couch.

FIG. 2 illustrates an example of a couch 200. A couch 200 is a piece of furniture for seating multiple people. A couch 200 is commonly found in the form of a bench with or without armrests. A couch 200 typically has cushions or other padding. This padding makes the couch 200 more comfortable for a user but isn't strictly necessary. The padding on the couch 200 can be seen in FIG. 1 but is left off of FIG. 2 so that other features of the couch 200 can be seen.

FIG. 2 shows that the couch 200 can include one or more legs 202. A couch 200 can include a solid base, but stackability is greatly reduced with a solid base. The legs 202 are configured to support the weight of the couch 200. In particular, at least a portion of the legs 202 rest on the ground (or another supporting surface). In addition, normally, but not always, the legs 202 are the only portions of the couch 200 that rest on the ground. That is, the sole support for the weight of the couch 200 and the user(s) is usually supported by the legs 202. It is normal for a couch 200 to have four legs 202 (one on each corner), but it may have one or more additional legs 202 in the center portion of the couch 200 to better support the weight.

As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

FIG. 2 also shows that the couch 200 can include armrests 204. The armrests 204 are on either side of the couch 200 and extend vertically far enough that the user can rest his/her arms on the armrests 204. The armrests 204 also prevent a user from sliding off the edge of the couch 200. The armrests 204 and the legs 202 can be a single piece or can be attached to one another.

FIG. 2 further shows that the couch 200 can include a seat area support 206. The seat area support 206 is the portion of the couch 200 that directly supports the weight of the user. I.e., the seat area support 206 may not be the actual surface on which the user sits but will be the portion that ultimately bears the weight of that surface and the user. The seat area support 206 is secured to the legs 202. The seat area support 206 stretches generally from one armrest 204 to the other and from the back rest to the front of the couch 200. The seat area support 206 can include any desired material, such as wood, aluminum, or steel. In general, the seat area support 206 will be parallel to the surface on which the couch 200 is placed. E.g., if the couch 200 is on a floor, then the seat area support 206 will be parallel to the floor (normally horizontal).

FIG. 2 additionally shows that the couch 200 can include a backrest 208. The backrest 208 is attached to the seat area support 206. The angle between the backrest 208 and the seat area support 206 is usually 90 degrees or close thereto. Thus, the backrest 208 is usually vertical, or close to vertical. The backrest 208 allows a user to sit on the seat area support 206 and then lean backward until his/her back makes contact with the backrest 208.

FIG. 2 moreover shows that couch 200 can include a pair of gaps 210. The gaps 210 are between the seat area support 206 and the arm rests 210. The gaps 210 are critical for allowing the couch 200 to be part of a stackable furniture set, such as the stackable furniture set 100 of FIG. 1. The gaps 210 may be wider at the rear of the seat area support 206 than at the front of the seat area support 206. This minimizes the size of the gap 210 but retains the ability to stack the couch 200.

FIG. 2 also shows that the couch 200 can include one or more apertures 212. The apertures 212 are in the face of the seat area support 206. The placement of the apertures 212 is critical to allow for stackability, as described below. The apertures 212 pass completely through the seat area support 206, allowing the legs of a piece of furniture stacked with the couch 200 to pass through the seat area support 206. The apertures 212 can be a single opening, or a series of openings, or even something that matches the pattern of the seat area support 206. For example, if the seat area support 206 is a metal weave, then the apertures 212 can be a particular gap in the weave. Thus, a user may not notice the aperture 212 relative to other portions of the seat area support 206 on sight.

The size and placement of the apertures 212 are critical to ensure stackability. In particular, if a club chair is being stacked on the couch 200 then one of the rear legs will be placed in one of the pair of gaps 210. The other rear leg will be placed in one of the apertures 212. Thus, the distance between a gap 210 and the nearest aperture 212 must be precise to allow the placement of the club chair.

Figure 3:
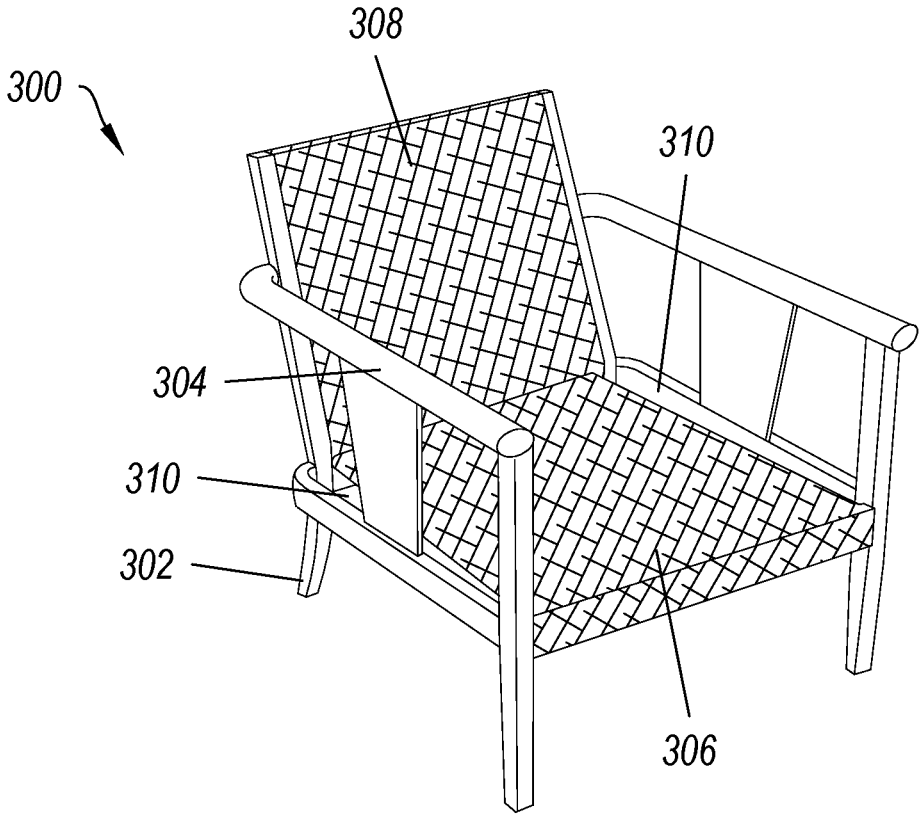
FIG. 3 illustrates an example of a club chair.

FIG. 3 illustrates an example of a club chair 300. The club chair 300 is a piece of furniture whereon a user sits providing support for the back and often the arms and typically standing on four legs. The club chair 300 typically has cushions or other padding. This padding makes the club chair 300 more comfortable for a user but isn't strictly necessary. The padding on the club chair 300 can be seen in FIG. 1 but is left off of FIG. 3 so that other features of the club chair 300 can be seen.

FIG. 3 shows that the club chair 300 can include one or more legs 302. A club chair 300 can include a solid base, but stackability is greatly reduced with a solid base. The legs 302 are configured to support the weight of the club chair 300. In particular, at least a portion of the legs 302 rest on the ground (or another supporting surface). In addition, normally, but not always, the legs 302 are the only portions of the club chair 300 that rest on the ground. That is, the sole support for the weight of the club chair 300 and the user(s) is usually the legs 302. It is normal for a club chair 300 to have four legs 302 (one on each corner).

FIG. 3 also shows that the club chair 300 can include armrests 304. The armrests 304 are on either side of the club chair 300 and extend vertically far enough that the user can rest his/her arms on the armrests 304. The armrests 304 also prevent a user from sliding off the edge of the club chair 300. The armrests 304 and the legs 302 can be a single piece or can be attached to one another.

FIG. 3 further shows that the club chair 300 can include a seat area support 306. The seat area support 306 is the portion of the club chair 300 that directly supports the weight of the user. I.e., the seat area support 306 may not be the actual surface on which the user sits but will be the portion that ultimately bears the weight of that surface and the user. The seat area support 306 is secured to the legs 302. The seat area support 306 stretches generally from one armrest 304 to the other and from the back rest to the front of the club chair 300. The seat area support 306 can include any desired material, such as wood, aluminum, or steel. In general, the seat area support 306 will be parallel to the surface on which the club chair 300 is placed. E.g., if the club chair 300 is on a floor, then the seat area support 306 will be parallel to the floor (normally horizontal).

FIG. 3 additionally shows that the club chair 300 can include a backrest 308. The backrest 308 is attached to the seat area support 306. The angle between the backrest 308 and the seat area support 306 is usually 90 degrees or close thereto. Thus, the backrest 308 is usually vertical, or close to vertical. The backrest 308 allows a user to sit on the seat area support 306 and then lean backward until his/her back makes contact with the backrest 308.

FIG. 3 moreover shows that club chair 300 can include a pair of gaps 310. The gaps 310 are between the seat area support 306 and the arm rests 310. The gaps 310 are critical for allowing the club chair 300 to stack with one another. While stacking one club chair 300 on another club chair 300 is not used in shipping or retail storage, it may be used for storage at home. I.e., it is a convenience for a user. The gaps 310 may be wider at the rear of the seat area support 306 than at the front of the seat area support 306. This minimizes the size of the gap 310 but retains the ability to stack the club chair 300.

Figure 4A:
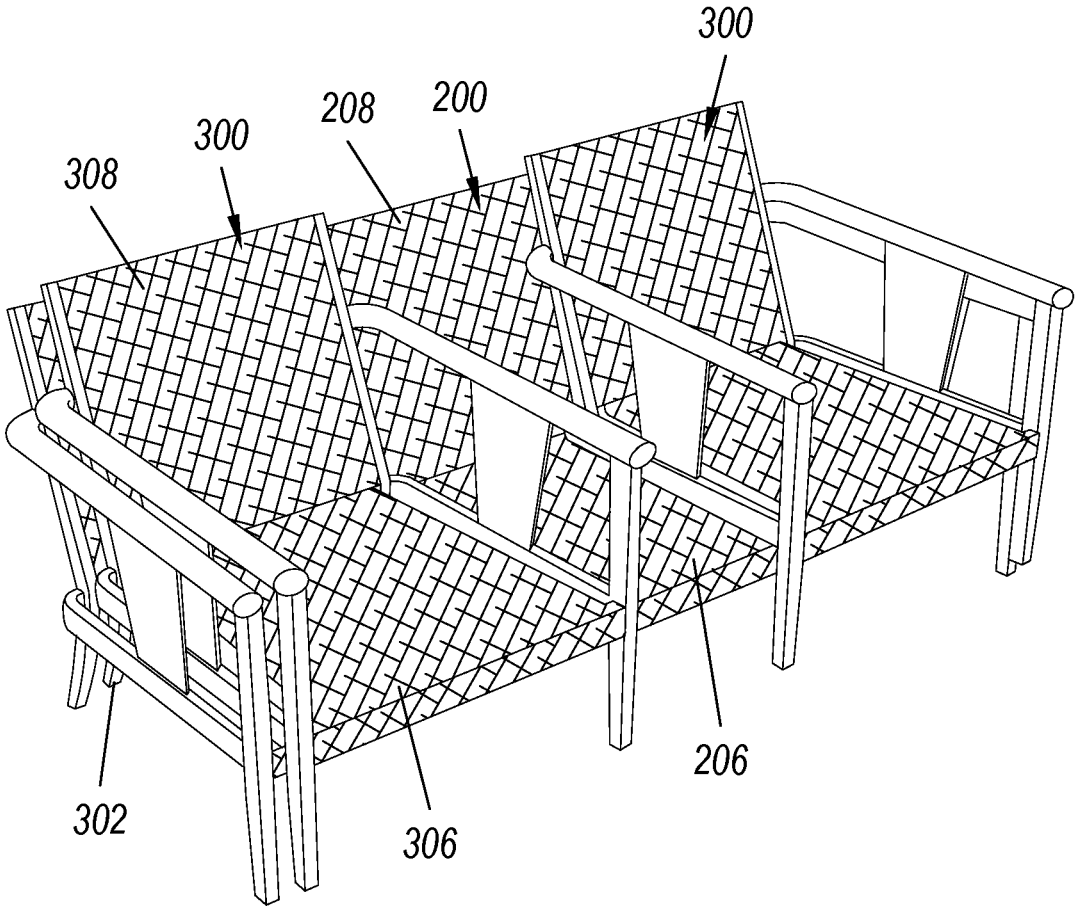
FIG. 4A is a front top view of an example of a pair of club chairs stacked on a couch.
Figure 4B:
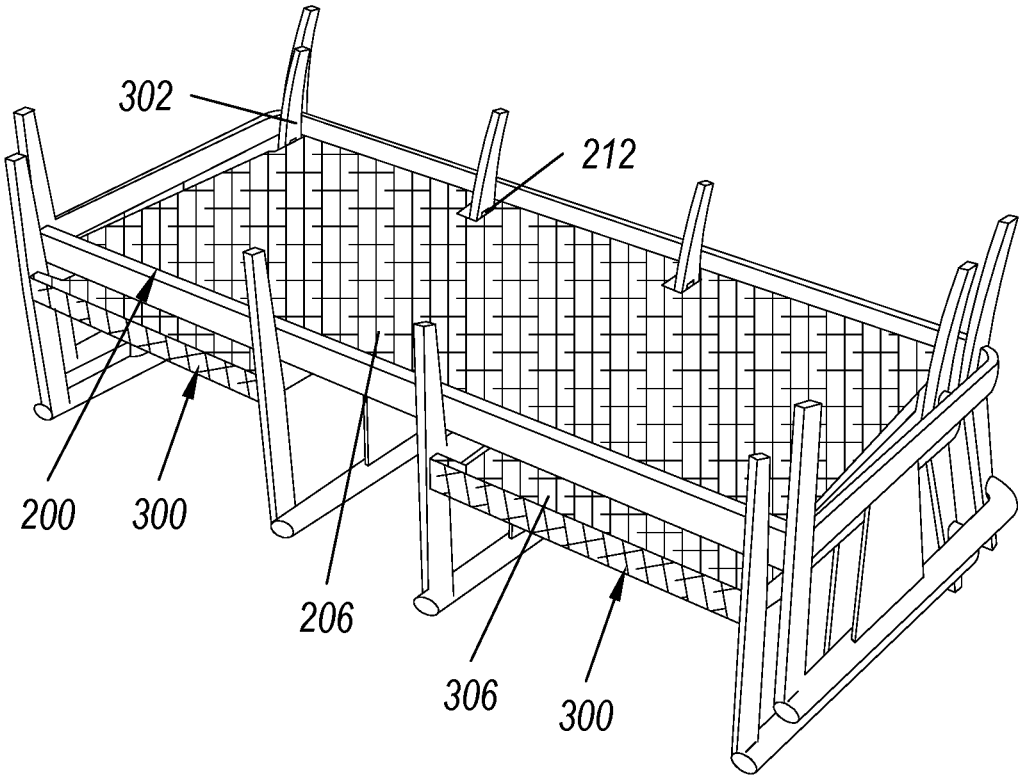
FIG. 4B is a front top view of the example of the pair of club chairs stacked on the couch.

FIGS. 4A and 4B (collectively "FIG. 4") illustrate an example of a pair of club chairs 300 stacked on a couch 200. FIG. 4A is a front top view of the example of the pair of club chairs 300 stacked on the couch 200; and FIG. 4B is a front top view of the example of the pair of club chairs 300 stacked on the couch 200. The design of the club chairs 300 and the couch 200 allow for storage and packaging in as compact a configuration as possible.

FIG. 4 shows that one of the rear legs 302 of the of each club chair 300 goes in one of the gaps 210 on the couch 200. The other rear leg 302 passes through the aperture 212 of the couch 200. This allows the seat area support 306 of the club chair 300 to rest on the seat area support 206 of the couch 200 and the backrest 308 of the club chair 300 to press against the backrest 208 of the couch 200. This minimizes the dead space between the club chair 300 and couch 200.

Figure 5:
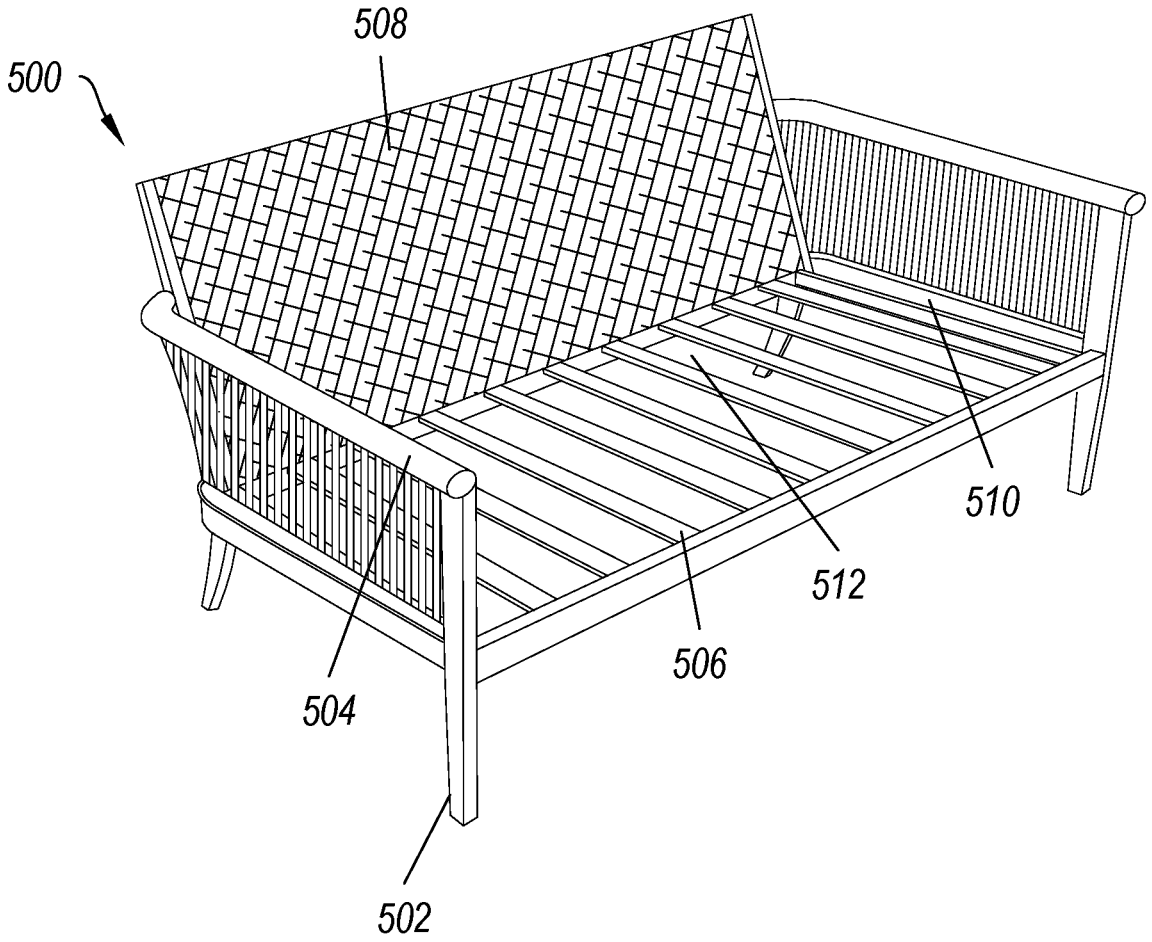
FIG. 5 illustrates an example of a loveseat.

FIG. 5 illustrates an example of a loveseat 500. A loveseat is similar to a sofa, except it seats only two people. That is, a sofa seats three or more people whereas a loveseat 500 only seats two people. This can create stackability problems because the loveseat 500 is close to the same width as two club chairs. Thus, there may be some structural differences which allow for stackability.

FIG. 5 shows that the loveseat 500 can include one or more legs 502. A loveseat 500 can include a solid base, but stackability is greatly reduced with a solid base. The legs 502 are configured to support the weight of the loveseat 500. In particular, at least a portion of the legs 502 rest on the ground (or another supporting surface). In addition, normally, but not always, the legs 502 are the only portions of the loveseat 500 that rest on the ground. That is, the sole support for the weight of the loveseat 500 and the user(s) is usually the legs 502. It is normal for a loveseat 500 to have four legs 502 (one on each corner), but it may have one or more additional legs 502 in the center portion of the loveseat 500 to better support the weight.

FIG. 5 also shows that the loveseat 500 can include armrests 504. The armrests 504 are on either side of the loveseat 500 and extend vertically far enough that the user can rest his/her arms on the armrests 504. The armrests 504 also prevent a user from sliding off the edge of the loveseat 500. The armrests 504 and the legs 502 can be a single piece or can be attached to one another.

FIG. 5 further shows that the loveseat 500 can include a seat area support 506. The seat area support 506 is the portion of the loveseat 500 that directly supports the weight of the user. I.e., the seat area support 506 may not be the actual surface on which the user sits but will be the portion that ultimately bears the weight of that surface and the user. The seat area support 506 is secured to the legs 502. The seat area support 506 stretches generally from one armrest 504 to the other and from the back rest to the front of the loveseat 500. The seat area support 506 can include any desired material, such as wood, aluminum, or steel. In general, the seat area support 506 will be parallel to the surface on which the loveseat 500 is placed. E.g., if the loveseat 500 is on a floor, then the seat area support 506 will be parallel to the floor (normally horizontal). One of skill in the art will appreciate that seat area support 506 need not be a solid surface, but can instead be a weave, a bed with gaps, etc.

FIG. 5 additionally shows that the loveseat 500 can include a backrest 508. The backrest 508 is attached to the seat area support 506. The angle between the backrest 508 and the seat area support 506 is usually 90 degrees or close thereto. Thus, the backrest 508 is usually vertical, or close to vertical. The backrest 508 allows a user to sit on the seat area support 506 and then lean backward until his/her back makes contact with the backrest 508.

FIG. 5 moreover shows that loveseat 500 can include a pair of gaps 510. The gaps 510 are between the seat area support 506 and the arm rests 510. The gaps 510 are critical for allowing the loveseat 500 to be part of a stackable furniture set, such as the stackable furniture set 100 of FIG. 1. The gaps 510 may be wider at the rear of the seat area support 506 than at the front of the seat area support 506. This minimizes the size of the gap 510 but retains the ability to stack the loveseat 500.

FIG. 5 also shows that the loveseat 500 can include one or more apertures 512. The apertures 512 are in the face of the seat area support 506. The placement of the apertures 512 is critical to allow for stackability, as described below. The apertures 512 pass completely through the seat area support 506, allowing the legs of a piece of furniture stacked with the loveseat 500 to pass through the seat area support 506. The apertures 512 can be a single opening, or a series of openings, or even something that matches the pattern of the seat area support 506. For example, the apertures 512 shown in FIG. 5 are part of a pattern of bands and spaces that form the seat area support 506. However, one of skill in the art will appreciate that other configurations of the apertures 512 can be used. For example, a single space 512 shaped as a slot can be placed along the back of the seat area support 506 near the backrest 508 which receives the back legs of two different club chairs. Likewise, two apertures 512 can be placed near each other such that the received club chair legs can be placed through the seat area support 506 near one another.

The size and placement of the apertures 512 are critical to ensure stackability. In particular, if a club chair is being stacked on the loveseat 500 then one of the rear legs will be placed in one of the pair of gaps 510. The other rear leg will be placed in one of the apertures 512. Thus, the distance between a gap 510 and the space 512 receiving the rear leg of the club chair must be precise to allow the placement of the club chair.

Figure 6:
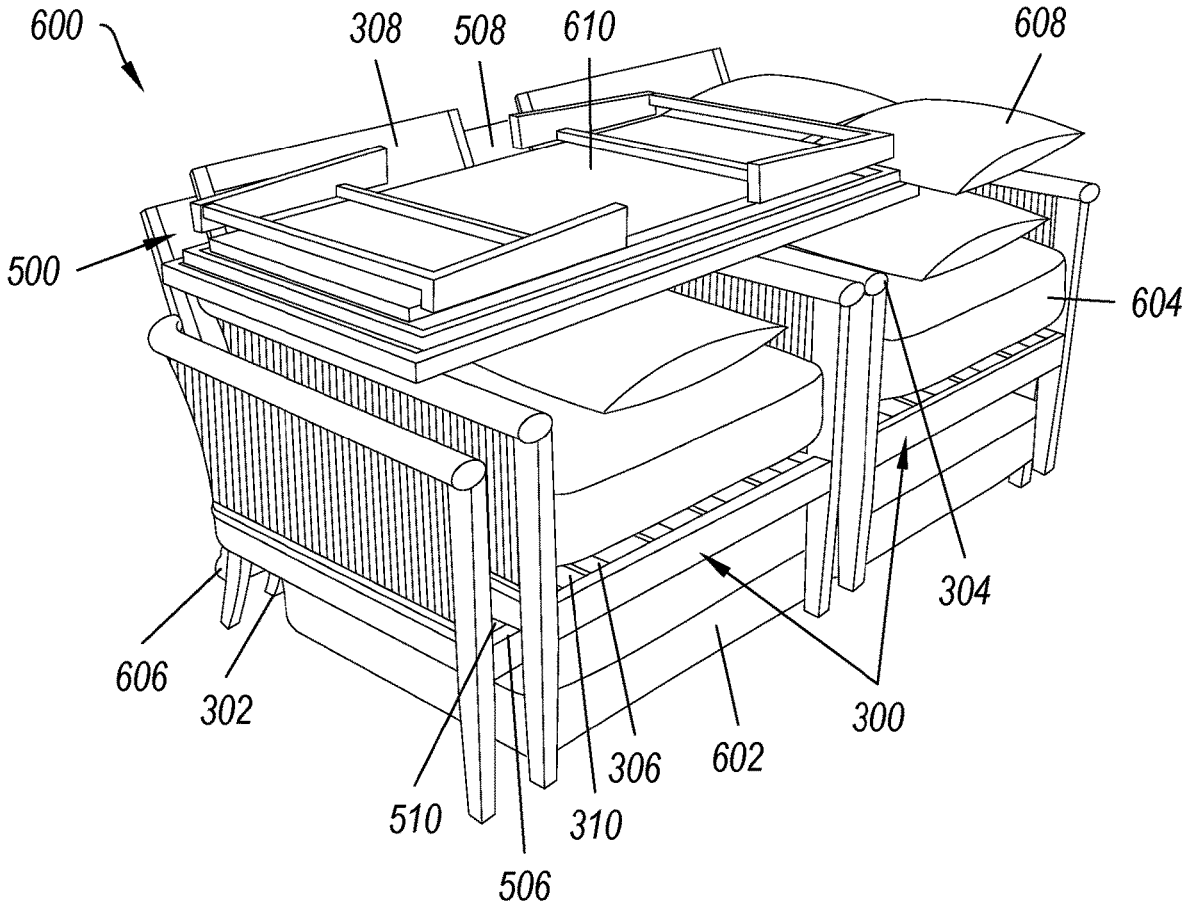
FIG. 6 illustrates an example of a stacked furniture set.

FIG. 6 illustrates an example of a stacked furniture set 600. The stacked furniture set 600 includes a loveseat 500 and club chairs 300. FIG. 6 shows just how compact the packaging, shipping and storage of the stacked furniture set 600 is compared to other furniture sets. Those sets have empty space, whereas the configuration shown in FIG. 6 shows that empty space is minimized and virtually eliminated.

FIG. 6 shows that one of the rear legs 302 of each club chair 300 goes in one of the gaps 510 on the loveseat 500. The other rear leg 302 passes through the apertures of the loveseat 500. This allows the seat area support 306 of the club chair 300 to rest on the seat area support 506 of the loveseat 500 and the backrest 308 of the club chair 300 to press against the backrest 208 of the loveseat 500. This minimizes the dead space between the club chair 300 and loveseat 500.

FIG. 6 also shows that the cushions 602 from the loveseat 500 can be placed in the gap under the seat area support 506 of the loveseat 500. This allows the gap between the seat area support 306 of the club chair 300 and the seat area support 506 of the loveseat 500 and the gap between the backrest 308 of the club chair 300 and the backrest 208 of the loveseat 500 to be minimized without causing any damage to the cushions. In particular, if the cushions 602 are left on the loveseat 500 then the club chairs cannot have a rear leg 302 in the gaps 510 or the apertures 512. Even if they could, the presence of the cushions 602 would push the club chairs up and out relative to the backrest 508, necessitating a larger storage space and increasing dead space within packaging. The same issues aren't presented by the cushions 604 of the club chairs 300 because there is not another piece of furniture that passes through the seat area support 306 of the club chair in the example presented in FIG. 6. However, one of skill in the art will understand that if multiple club chairs are part of the stackable furniture set 600 (with higher club chairs 300 passing through the gaps 310 of the lower club chairs 300 and appropriate apertures 512 in the love seat 500) then cushions 604 can remain on the higher club chairs 300 but not on the lower club chairs 300.

FIG. 6 further shows that the back cushions 606 are placed in the rear of the loveseat 500. The rear of the loveseat 500 is typically not completely vertical. That is there is often a bend or arch formed by the legs 502 and the backrest 508 and the rear cushions 606 are placed in the gap formed by that arch. The back cushions of the club chairs 300 aren't shown, but they can be likewise in the rear of the loveseat 600 or on top of the cushions 604 of the club chair, depending on sizing and spacing.

FIG. 6 additionally shows that the inner armrests 304 of the club chairs 300 are very near one another or even touching. This allows the horizontal spacing to be minimized just as the vertical spacing is minimized. If the loveseat 500 is wide enough (or replaced with a sofa), then the gap between the inner armrests 204 of the club chairs 300 can be filled with other components (e.g., with the components of an end table).

FIG. 6 moreover shows that the stackable furniture set 600 can include standalone components such as pillows 608. Pillows 608 are small and can fit in gaps that other larger components can't, so they can be placed easily into empty spaces.

FIG. 6 also shows that the stackable furniture set 600 can include a coffee table 610. The coffee table 610 is known as "knock-down" furniture (often abbreviated as "KD" or called ready to assemble—RTA—or kit furniture), meaning that the user must complete some assembly. Because of that, the components of the coffee table 610 fold down flat. They are then placed on the armrests 304 of the club chairs 300. This allows them to rest in the space that is created because the armrest 304 do not extend vertically as high as the backrests 508.

Because of the efficiency in packaging, the amount of packaging and storage/shipping space is greatly reduced, which decrease consumer prices. For example, the stackable furniture set 600 is a four-piece set that fits in a single box that is 680 mm in length by 945 mm in width by 850 mm in height. Without making the furniture set stackable, the same furniture set takes 4 boxes. In addition, much less packaging is needed, since packaging is often used to fill empty space to prevent movement. This leads to a cost savings of approximately 50% on packaging, approximately 30% on shipping and approximately 40% on storage. While the weight of the furniture doesn't change or changes only minimally, there is a reduction in the weight of the packaging of between 7 and 10 pounds of packaging material. This is packaging material that does not need to be disposed of. In addition, there are other benefits that are less tangible. For example, a single box is easier for a consumer to get the furniture set home from a store because it takes less cargo space.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stackable furniture set, the stackable furniture set comprising:
- a first seat, wherein the first seat includes:
  - four legs;
  - a first armrest;
  - a second armrest;
  - a seat area support, wherein:
    - the seat area support is configured to support the weight of a user;
    - the seat area support is supported by the four legs;
    - the first armrest is attached to a first end of the seat area support; and
    - the second armrest is attached to the second end of the seat area support, wherein the second end is opposite the first end;
  - a first gap between the first armrest and the seat area support;
  - a second gap between the second armrest and the seat area support;
  - one or more apertures in the seat area support;
- a second seat, wherein the second seat includes:
  - four legs;
  - a seat area support, wherein:
    - the seat area support is configured to support the weight of a user; and
    - the seat area support is supported by the four legs; and
- wherein the distance between a first rear leg of the second seat and a second rear leg of the second seat is equal to the distance between the first gap and one of the one or more apertures such that the first rear leg of the second seat can be placed in the first gap and the second rear leg of the second seat can be placed on one of the one or more apertures.

2. The stackable furniture set of claim 1, wherein the first seat includes a sofa.

3. The stackable furniture set of claim 1, wherein the first seat includes a loveseat.

4. The stackable furniture set of claim 1, wherein the second seat includes a loveseat.

5. The stackable furniture set of claim 1, wherein the second seat includes a club chair.

6. The stackable furniture set of claim 1, wherein the first seat includes one or more cushions configured to be placed on the seat area support of the first seat.

7. The stackable furniture set of claim 1, wherein the first seat includes one or more cushions configured to be placed on the seat area support of the second seat.

8. The stackable furniture set of claim 1, wherein the one or more apertures includes a first hole and a second hole.

9. The stackable furniture set of claim 1, wherein the one or more apertures includes a first slot and a second slot.

10. The stackable furniture set of claim 1, wherein the depth of the seat area support of the second seat is equal to the depth of the seat area support of the first seat.

11. A stackable furniture set, the stackable furniture set comprising:
- a couch, wherein the couch includes:
  - four legs;
  - a first armrest;
  - a second armrest;
  - a seat area support, wherein:
    - the seat area support is configured to support the weight of a user;
    - the seat area support is supported by the four legs;
    - the first armrest is on a first end of the seat area support; and
    - the second armrest is on the second end of the seat area support;
  - a first gap between the first armrest and the seat area support;
  - a second gap between the second armrest and the seat area support;
  - one or more apertures in the seat area support;
  - a backrest, wherein the backrest is attached to the seat area support; and a pair of club chairs, wherein each of the club chairs includes:
four legs;
a seat area support, wherein:
the seat area support is configured to support the weight of a user;
the seat area support is supported by the four legs;
a backrest, wherein the backrest is attached to the support; and
wherein the distance between a first rear leg of the club chair and a second rear leg of the club chair for each of the pair of club chairs is equal to the distance between the first gap and one of the one or more apertures such that for each club chair the first rear leg of the club chair can be placed in the first gap and the second rear leg of the club chair can be placed on one of the one or more apertures.

12. The stackable furniture set of claim 11, wherein the stackable furniture set further a coffee table.

13. The stackable furniture set of claim 11, wherein the stackable furniture set further comprises an end table.

14. The stackable furniture set of claim 11, wherein the stackable furniture set further comprises one or more footrests.

15. The stackable furniture set of claim 11, wherein the armrests of the couch are higher than the seat area support.

16. The stackable furniture set of claim 11, wherein the armrests of each of the club chairs are higher than the seat area support.

17. A stacked furniture set, the stacked furniture set comprising:
a couch, wherein the couch includes:
four legs;
a first armrest;
a second armrest;
a seat area support, wherein:
the seat area support is configured to support the weight of a user;
the seat area support is supported by the four legs;
the first armrest is attached to a first end of the seat area support; and
the second armrest is attached to the second end of the seat area support, wherein the second end is opposite the first end;
a first gap between the first armrest and the seat area support;
a second gap between the second armrest and the seat area support;
a first aperture in the seat area support wherein the first aperture is closer to the first gap than the second gap;
a second aperture in the seat area support wherein the second aperture is closer to the second gap than the first gap;
a backrest, wherein the backrest is attached to the seat area support;
a first club chair, wherein the first club chair includes:
four legs, the four legs including:
a first rear leg;
a second rear leg;
a first front leg; and
a second front leg;
a seat area support, wherein:
the seat area support is configured to support the weight of a user;
the seat area support is supported by the four legs;
a backrest, wherein the backrest is attached to the seat area support; and
a second club chair, wherein the first club chair includes:
four legs, the four legs including:
a first rear leg;
a second rear leg;
a first front leg; and
a second front leg;
a seat area support, wherein:
the seat area support is configured to support the weight of a user;
the seat area support is supported by the four legs;
a backrest, wherein the backrest is attached to the seat area support; and
wherein:
the first rear leg of the first club chair passes through the first gap in the couch;
the second rear leg of the first club chair passes through the first aperture in the couch;
the first rear leg of the second club chair passes through the second gap in the couch; and
the second rear leg of the second club chair passes through the second aperture in the couch.

18. The stackable furniture set of claim 17, wherein the first front leg and the second front leg of the first club chair don't pass through the seat area support of the couch.

19. The stackable furniture set of claim 17, wherein the seat area support of the first club chair and the second club chair rest on the seat area support of the couch.

20. The stackable furniture set of claim 17, wherein the seat area support of the couch includes at least one of:
wood
aluminum; or
steel.

* * * * *